US005407404A

United States Patent [19]

Killian et al.

[11] Patent Number: 5,407,404

[45] Date of Patent: Apr. 18, 1995

[54] EXERCISE APPARATUS WITH LIFT ASSISTANCE MECHANISM

[75] Inventors: Brian R. Killian, Renton; Peter L. Kennedy, Redmond, both of Wash.

[73] Assignee: Tunturi, Inc., Redmond, Wash.

[21] Appl. No.: 130,905

[22] Filed: Oct. 4, 1993

[51] Int. Cl.[6] ..... A63B 23/12

[52] U.S. Cl. ..... 482/38; 482/123; 482/130

[58] Field of Search ..... 482/26, 38–42, 482/100, 112–113, 121–130, 137, 142

[56] References Cited

U.S. PATENT DOCUMENTS

| | | | |
|---|---|---|---|
| 3,707,285 | 12/1972 | Martin . | |
| 4,582,320 | 4/1986 | Shaw . | |
| 4,620,701 | 11/1986 | Mojden | 482/142 X |
| 4,638,995 | 1/1987 | Wilson | 482/38 X |
| 4,645,197 | 2/1987 | McFee | 482/130 X |
| 4,666,154 | 5/1987 | Lipscomb et al. | 482/142 |
| 4,749,286 | 6/1988 | White | 482/129 X |
| 4,815,731 | 3/1989 | Soarez et al. | 482/126 X |
| 4,846,458 | 7/1989 | Potts | 482/26 |
| 4,850,589 | 7/1989 | Block | 482/41 X |
| 5,011,139 | 4/1991 | Towley, III | 482/40 X |
| 5,135,216 | 8/1992 | Bingham et al. . | |

*Primary Examiner*—Richard J. Apley
*Assistant Examiner*—John Mulcahy
*Attorney, Agent, or Firm*—Graybeal Jackson Haley & Johnson

[57] ABSTRACT

Exercise apparatus incorporating lift assistance mechanism for pull-up and/or dip stand exercising including one or more interchangeable extensible, elastomeric links of various extensil resistances, arranged to upwardly bias a pivotally mounted lift bar, and having arranged in parallel therewith a hydraulic shock absorber type fluid cylinder functioning to limit the extent of downward movement of the lift bar when the cylinder is extended to its maximum length and limiting the rate of upward movement of the lift bar in the event of the user falling off. The elastomeric link is preferably longitudinally bifurcated with two lengthwise parts so that if one part breaks the other part is likely to remain intact and provide some degree of extensil resistance. Other exercise components can be included as well as parts of the apparatus, such as push-up handles, and padded cross bars for sit-up exercising and the like.

8 Claims, 5 Drawing Sheets

EXERCISE APPARATUS WITH LIFT ASSISTANCE MECHANISM

FIELD OF THE INVENTION

This invention relates to exercise apparatus and more particularly to free standing exercise apparatus including lift assistance mechanism which is variable as to degree of assistance in pull-up and/or dip stand type exercising and which acts as a shock absorber type safety mechanism.

DESCRIPTION OF THE PRIOR ART

Horizontal bar exercise devices are well-known which incorporate lift assistance means. A specific example of such is found in Martin U.S. Pat. No. 3,707,285. In the mechanisms there disclosed a lower cross bar carries a platform on which the user stands while grasping a pull-up cross bar or dip stand handles and the user is assisted in lifting movement by tensioned elastic spring elements arranged between stationary uprights and the lower platform. However, in such a mechanism the extent of movement of the lower platform and the elastic spring elements attached thereto is not restricted either as to rate of movement or as to extent of movement, short of hitting the floor or other support surface, in the case of breakage of the lift assisting spring elements. This manifestly provides less than ideal apparatus from a safety point of view.

SUMMARY OF THE INVENTION

Objects and features of the present invention include the provision in multi-purpose exercise apparatus of lift assistance components with interchangeable, extensible, elastomeric links of various resistances, which are used in conjunction with a shock absorber type fluid cylinder functioning to limit the rate of upward movement of the lift bar in the event that the user slips off of the lift bar and prevent the lift bar from hitting the user's body. These controlled list assistance components, readily adaptable to various levels of assistance, and having safeguards so that injury of a user is more readily avoided, provide advantages not realized by known exercise equipments of a similar nature.

DESCRIPTION OF THE DRAWINGS

These and other features and advantages of the invention will be apparent from the accompanying illustrations and description of a typical embodiment thereof as shown in the accompanying drawings, wherein.

DESCRIPTION OF THE PREFERRED EMBODIMENTS

Figure 1:
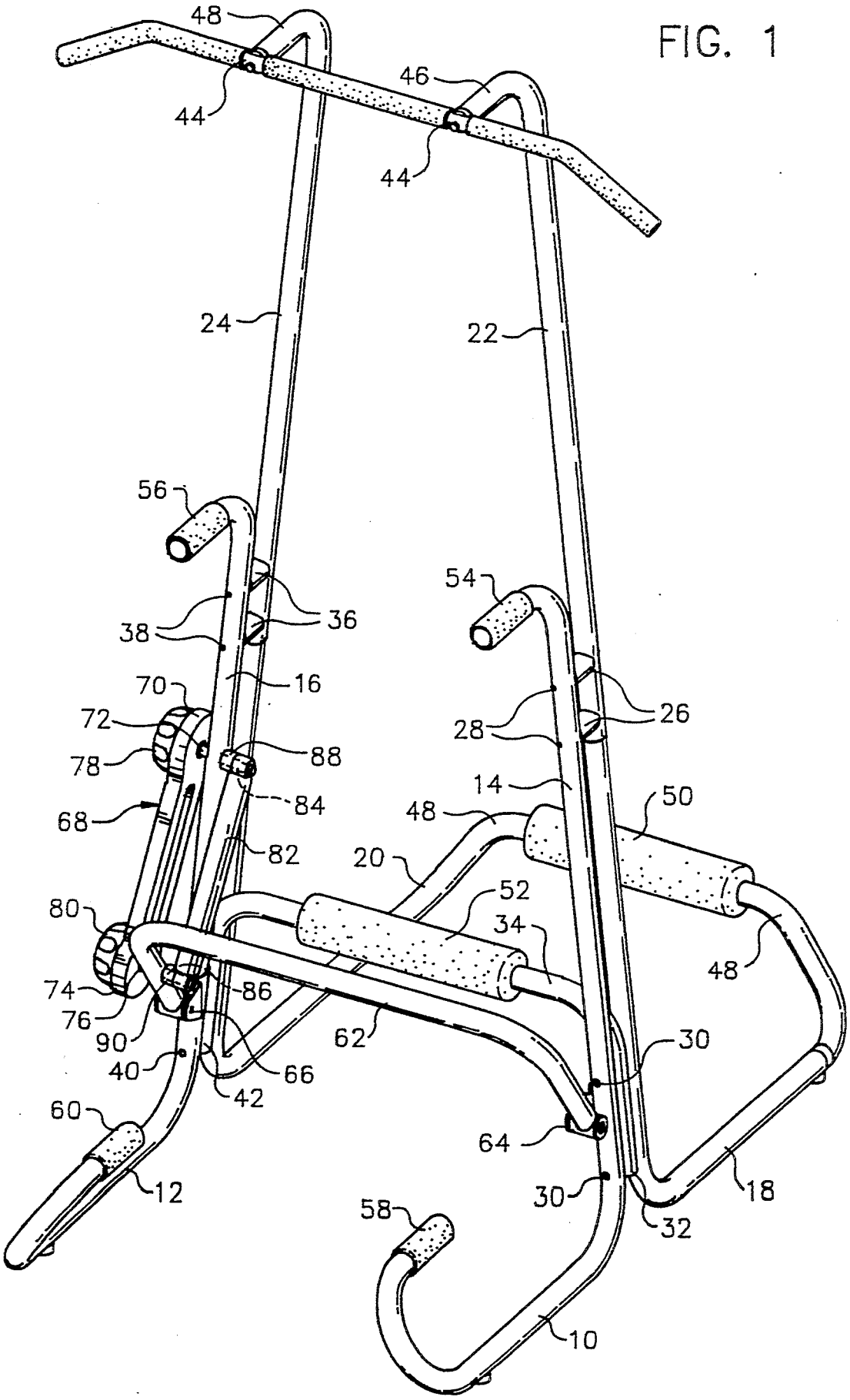
FIG. 1 is an isometric view from a forward and right-hand aspect of an exercise apparatus embodying the invention.

As shown in the figures, the illustrated exercise apparatus is free standing and comprises principally tubular components forming floor engaging forward base members 10, 12, formed integrally with intermediate upright members 14, 16, and rearward left and right floor engaging base members 18, 20 formed integrally with respective full height upright members 22, 24. The uprights 14, 22 are rigidly joined together by tubular braces 26 and associated belts 28 in the upper portion and in the lower portion by bolts 30 which also fasten to the uprights 14, 22, the downwardly curved end 32 of a lower level cross bar 34. Similarly, uprights 16, 24 are joined together in the upper portion by tubular stubs 36 and bolts 38 and in the lower portion by bolts, one of which is shown at 40 which fasten together the uprights 16, 24 through the curved lower end 42 of the cross bar 34.

Pull-up bar 44 is bolted to the respective upper ends 46, 48 of the uprights 22, 24 and is covered intermediately and at the ends thereof with elastomeric grip material in a manner conventional per se.

The rear extremities of the rear floor-engaging base members 18, 20 are interconnected by a second lower level cross bar 48 similar to the cross bar 34 and both are covered with respective elastomeric foam elements 50, 52. These cross bars 34, 48 are useful in performing various exercises, such as sit-ups.

Similarly, to provide a wide variety of exercising alternatives for the user, the intermediate uprights 14, 16 are curved to a horizontal attitude and provided with elastomeric covered dip-stand handle means respectively indicated at 54, 56. Similarly, also, the forward ends of the respective forward floor engaging base members 10, 12 are curved inwardly and upwardly to horizontal attitudes and provided with elastomeric coverings to form respective push-up handle means 58, 60.

In a generally forward position, and generally directly below the pull-up bar 44 and the dip-stand handle means 54, 56, is a lift bar 62 journaled for pivotal movement on respective end brackets 64, 66 on the lower portions of respective intermediate uprights 14, 16. Said lift bar 62 is biased to an upper pivotal position as shown in FIG. 3, and in solid line in FIG. 2, by connection to it of an extensible elastomeric link means generally indicated at 68 which is attached at its upper end 70 to a pin 72 projecting outwardly from the left hand intermediate upright 16 and which at its lower end 74 is attached to a pin 76 extending outwardly from an intermediate position as shown on the end portion of the lift bar 62. The pins 72, 76 are threaded on the outboard ends thereof (not shown) and respective upper and lower threaded knobs 78, 80 are provided for ready assembly and disassembly of the link means 68 on and off the pins 72, 76.

In accordance with the invention, the illustrated exercise apparatus comprises several such elastomeric link means 68 of various extensil resistances, e.g. with 25 pound, 50 pound, 75 pound and 100 pound pull resistances, for example, so that a given user can select the amount of lift assistance desired during chinning exercising.

Figure 2:
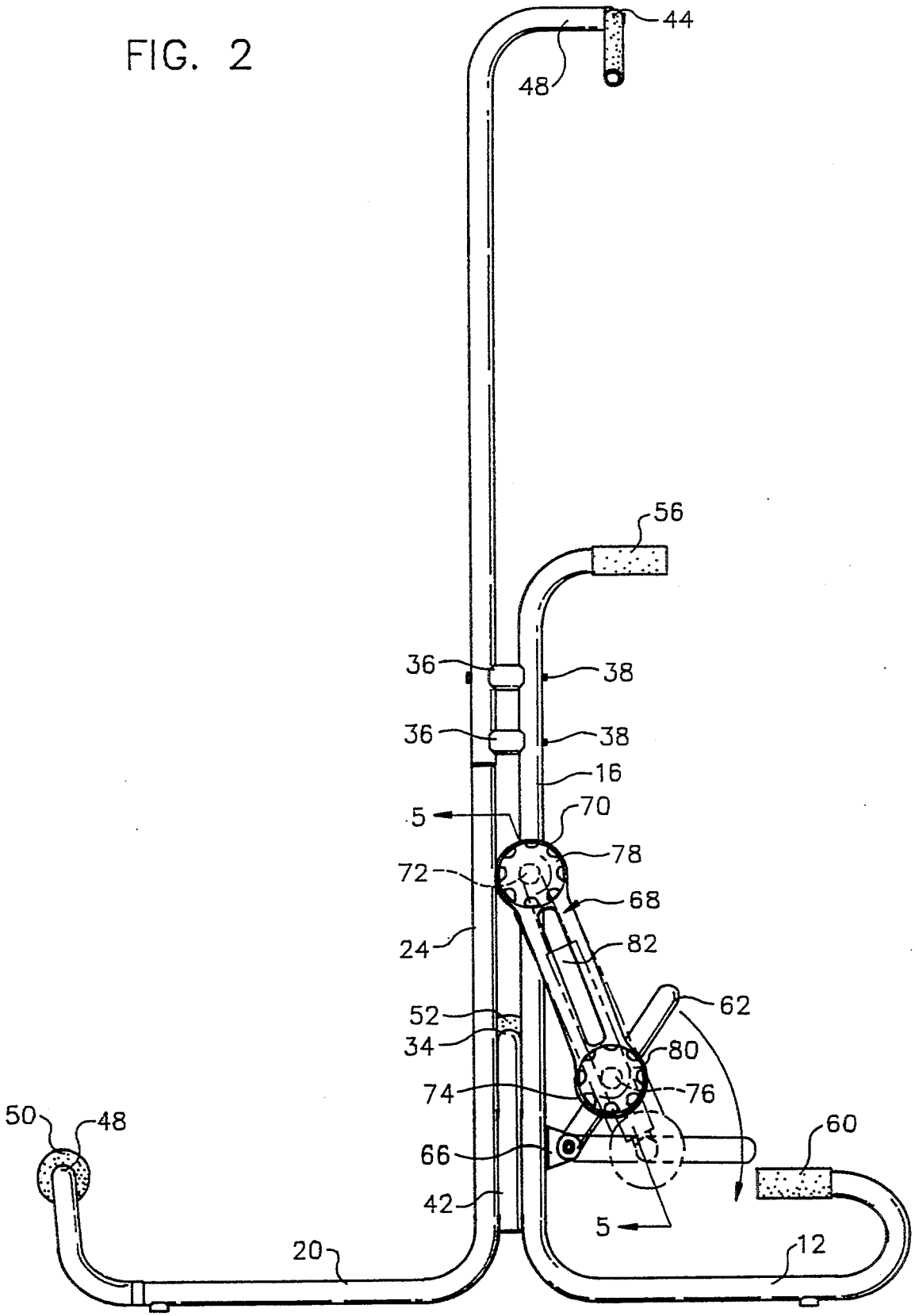
FIG. 2 is a left-hand side view thereof.
Figure 3:
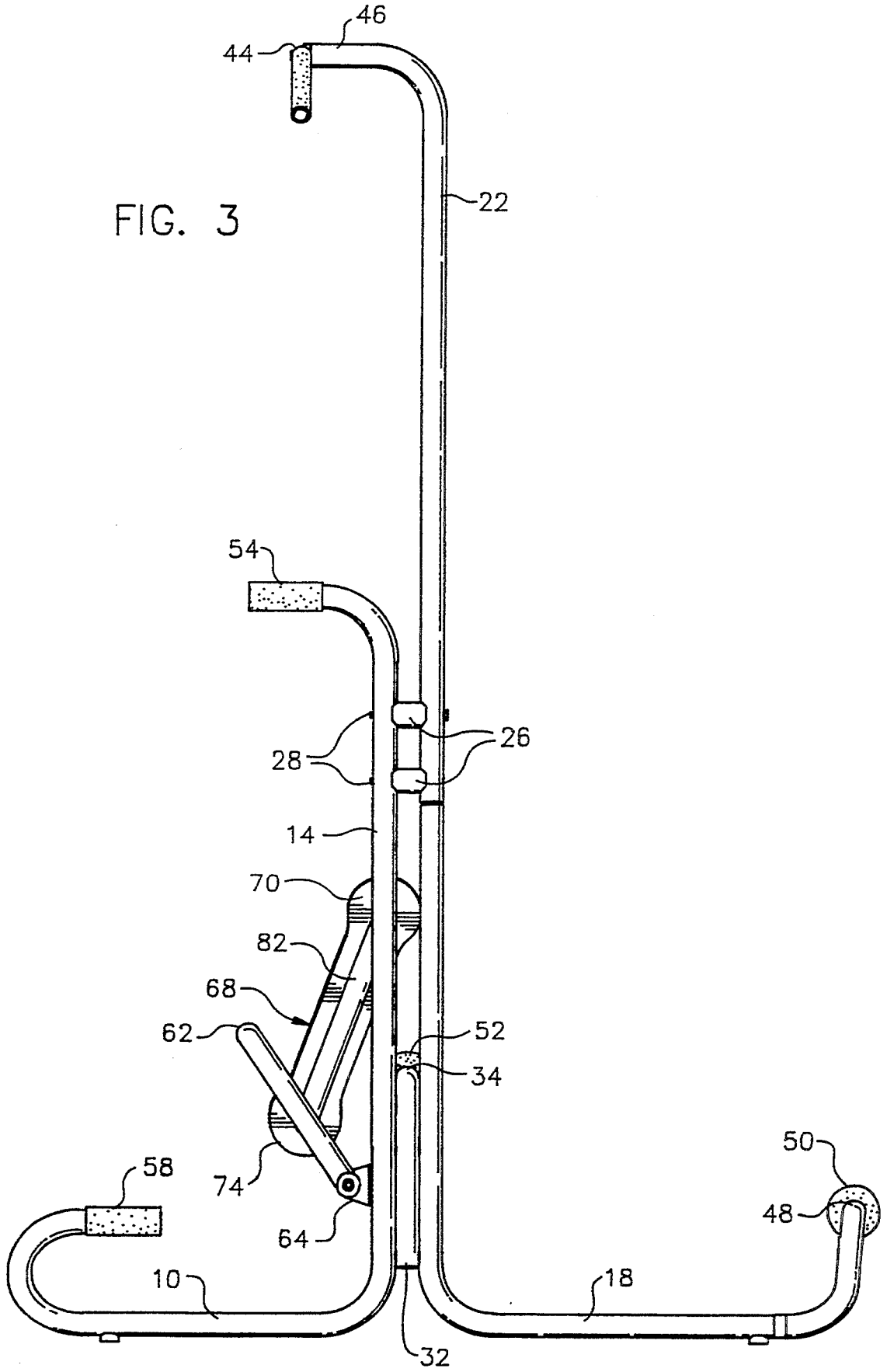
FIG. 3 is a right-hand side view thereof.
Figure 4:
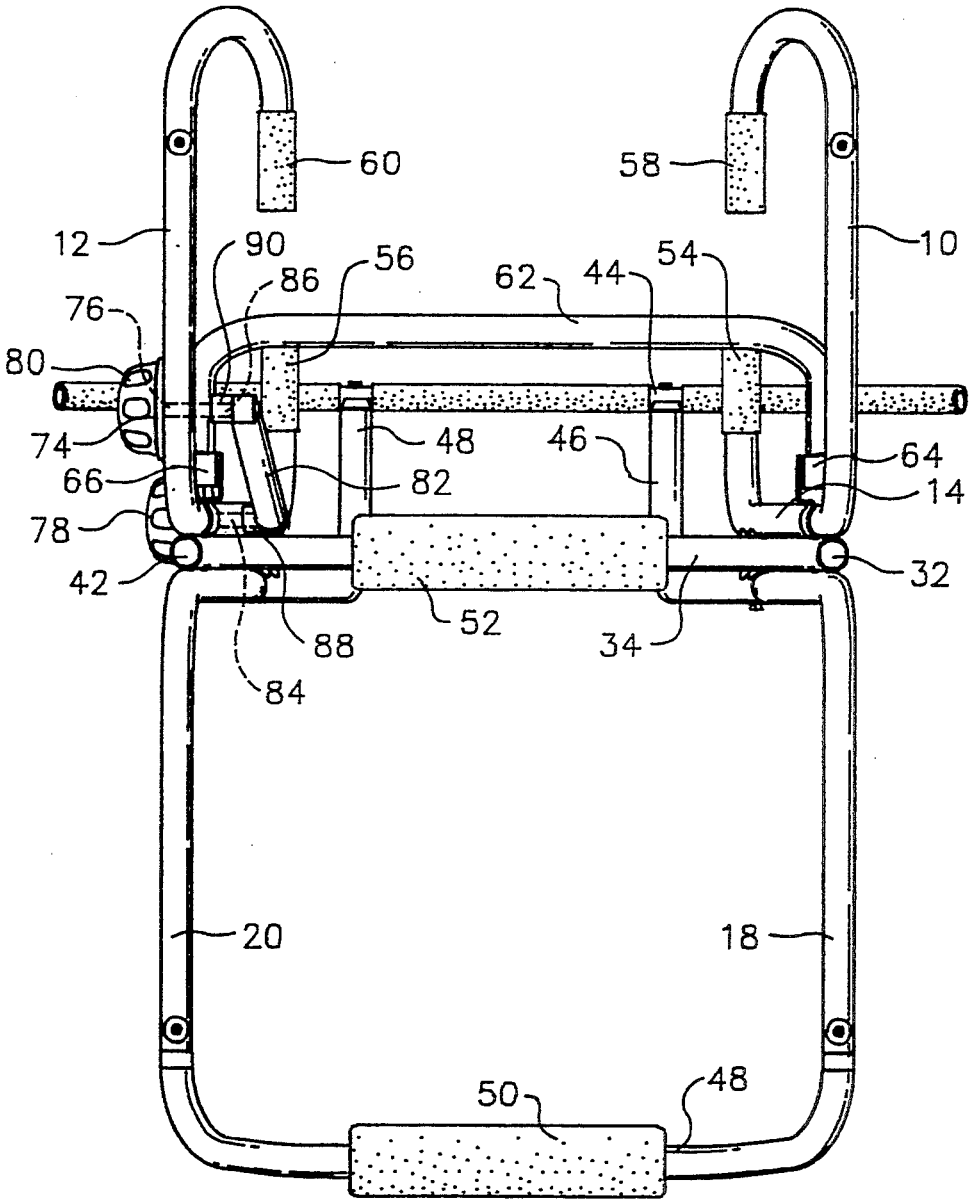
FIG. 4 is a bottom view thereof.
Figure 5:
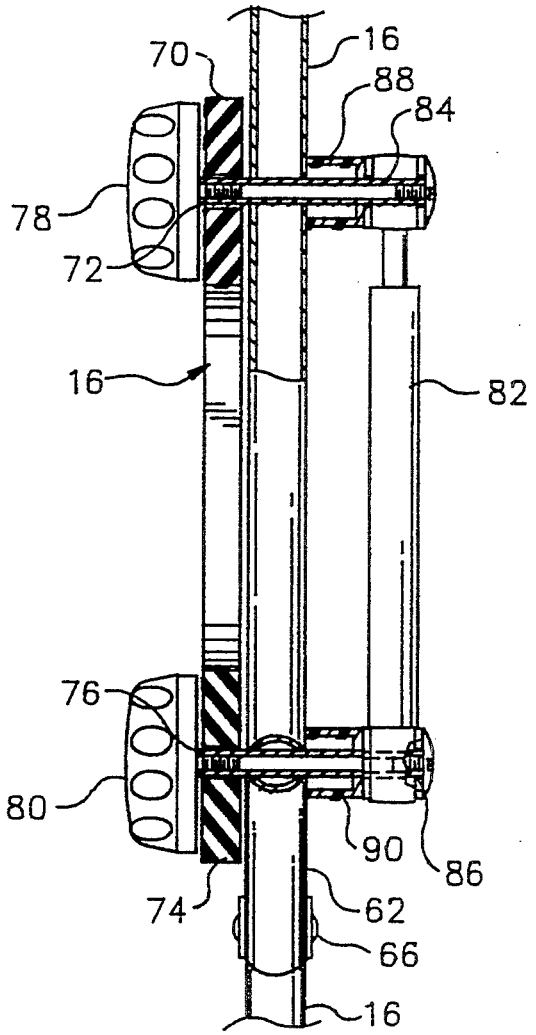
FIG. 5 is an enlarged detail view, partly in cross-section, showing the mounting and interconnection of the elastomeric link means and fluid cylinder means by which the resistance and extent and rate of movement of the lift bar are controlled.

Preferably, the extensible elastomeric link means 68 is in a form such as shown in FIGS. 1–3 with a configuration involving lengthwise bifurcation intermediate the ends thereof. This is so that, in the event of breakage of one intermediate portion while a user is standing on the lift bar 62, the other intermediate portion is likely to remain intact and provide some degree of continued extensil resistance until the link can be replaced.

In a manner also characteristic of the present invention, the embodiment thereof illustrated in FIGS. 1–4 also includes a fluid cylinder means 82 extending between an upper mounting pin 84 on the intermediate upright 16 inboardly thereof and a mounting pin 86 on an intermediate point on the end segment of the lift bar 62, with said pins 84, 86 being preferably placed in axial alignment with respective mounting pins 72, 76 for the elastomeric link means 68. Plastic spacers 88, 90 are arranged coaxially on respective pins 84, 86 to provide clearance between the upright 16 and cylinder 82 as the latter moves.

Fluid cylinder 82 is preferably of a type involving a conventional shock absorber design per se, with restricted gas or hydraulic fluid flow during extension and with characteristic limitations as to the rate of extensil movement and as to the extent of extensil movement. Such a fluid cylinder means acts as a movement limiting and safety device in the context of the apparatus disclosed in that it has a maximal extent of extensil movement which limits the extent of downward movement of the lift bar 62, such as shown by the broken line showing of the lift bar in FIG. 2 and it also provides a safety feature in that the rate of movement of the lift bar is limited or restrained, with the result that any unduly abrupt movement, which might which might otherwise subject a user to the risk of injury, is avoided.

As will be apparent, a user of the apparatus illustrated for assisted pull-up chinning exercising can stand on the lift bar 62 and, assuming the user has adequate weight more than the resistance rating of the elastomeric link means 68, the user's weight will depress the lift bar to a horizontal position as shown in FIG. 2. The user can then grasp either the pull-up bar 44 or the dip stand handle means 54, 56 and perform a chinning or lifting movement against a resistance which is dictated by the user's weight less whatever lifting (upward force) is provided by the elastomeric link means 68. With such assistance in the chinning or lifting action, the user can exercise with less strength and strain than would otherwise be involved if the lifting or chinning were resisted by the user's entire weight. Then, as an exercise program progresses, the extent of assistance to the lifting or chinning can be reduced by using a lesser rated elastomeric link means with lesser extensil resistance, the substitution of which, one for the other, simply involves unthreading of the knobs 78, 80 from pins 72, 76 and removal of a given link means 68 and replacement of the link means with another link means 68, followed by replacement of the knobs 78, 80 on the pins 72, 76.

As a preferred example of the shock absorber type hydraulic cylinder 82 which can be used as the movement limiting and safety mechanism of the lifter apparatus illustrated, the hydraulic cylinder manufactured by MDI-Fu Long Traffic Parts Co., Ltd. of Taiwan has a collapsed or retracted length of 355 mm (about 14 inches), an extended length of 565 mm (about 23 inches) and a travel of about 210 mm (about 8.3 inches). Characteristically it has minimal resistance to change of length at 10 mm per second or less for compression and rebound and at speeds over 10 mm per second the velocity becomes 200 pounds force at 1 mm per second for compression only. The rebound resistance is always minimal. In terms of a preferred form of flexual, elastomeric resistance element, the form thereof can be similar to that shown in Bingham et al U.S. Pat. No. 5,135,216, owned by ProForm Fitness Products, Inc. except that the resistance assembly is molded all in one piece.

As will be evident, the exercise apparatus shown in the drawings and discussed above can be modified to be an assisted pull-up apparatus only, with dip stand and push-up handles omitted, or redesigned for dip stand use only, with the pull-up bar omitted, and with or without the push-up handles, for example.

As will also be evident, further modifications can be made of the mechanism and arrangement of components shown. Thus, simply by way of further example, the flexural, extensil elements 68 can be used in pairs, preferably one at each side of the lift bar, and the fluid cylinder elements 82 can also be used in pairs, if desired. Apparent also is the fact that other arrangements for alternative exercising, or omission thereof can be incorporated in or left out of the mechanism, the important consideration in this respect being that the mechanism if constructed according to the invention includes both one or more flexural extensible elements and one or more fluid cylinder elements operating in parallel with the one or more extensible elements for the purpose of pull-up assistance.

These and other variations and adaptations of the invention will occur to those skilled in the art to which the invention is addressed, within the scope of the following claims.

What is claimed is:

1. A free standing exercise apparatus for use in assisted lift exercising, comprising:

floor engaging base members connected to an upright support which in the lower portion thereof is spanned by a lift bar mounted on said upright support for pivotal movement about a horizontal axis; a graspable member fixedly mounted to said upright support above said lift bar and spaced from said lift bar so as to allow a user standing on said lift bar to grasp said graspable member; extensible, elastomeric link means connected between said upright support and said lift bar for maintaining said lift bar in a relatively upward position when there is no weight exerted downwardly on the lift bar and for permitting the lift bar to move pivotally downwardly under the force of weight exerted downwardly on the lift bar; and hydraulic shock absorber means interconnecting said upright means and said lift bar in parallel with said elastomeric link means so as to extend with downward movement of the lift bar, said hydraulic shock absorber means characteristically having low resistance to extension and low rates of compression and relatively high resistance to high rates of compression and acting when extended to its maximum length as stop means limiting the extent of downward movement of said lift bar, and acting as safety means limiting the rate of upward movement of the lift bar in the event of the user slipping off.

2. Exercise apparatus according to claim 1, wherein said elastomeric link means and the connections thereof to said upright support and said lift bar are such that said elastomeric link means is readily removable and replaceable on said upright support and said lift bar, said exercise apparatus comprising a plurality of said elastomeric link means with respectively different extensil resistance characteristics so that a user can selectively vary the extent of downwardly exerted weight necessary to pivotally move said lift bar during use of the apparatus.

3. Exercise apparatus according to claim 1, wherein said elastomeric link means is bifurcated lengthwise intermediate the ends thereof so that in the event of breakage of one intermediate portion the other intermediate portion is likely to remain intact and provide some degree of extensil resistance.

4. Exercise apparatus according to claim 1, further comprising a lower level cross bar spanning said floor engaging base members in horizontally spaced relation to said upright support for use in exercising activities other than lift assisted exercising.

5. An exercise apparatus according to claim 1, wherein said graspable member comprises a pull-up bar at an overhead location above said lift bar on said upright support for use in assisted pull-up exercising.

6. An exercise apparatus according to claim 1, further comprising push-up handle means at a lower level connected with said base members at locations horizontally spaced from said upright means.

7. An exercise apparatus according to claim 1, wherein said graspable member comprises a pair of dip stand handles at intermediate locations on said upright support spaced generally directly above said lift bar.

8. A free standing exercise apparatus for use in assisted pull-up exercising, comprising:

floor engaging base members connected to an upright support in turn spanned in the upper portion thereof by a pull-up bar, said upright support in the lower portion thereof being spanned by a lift bar mounted on said upright support generally directly below said pull-up bar for pivotal movement about a horizontal axis; extensible, elastomeric link means connected between said upright support and said lift bar for maintaining said lift bar in a relatively upward position when there is no weight exerted downwardly on the lift bar and for permitting the lift bar to move pivotally downwardly under the force of weight exerted downwardly on the lift bar; and hydraulic shock absorber means interconnecting said upright support and said lift bar in parallel with said elastomeric link means so as to extend with downward movement of the lift bar, said hydraulic shock absorber means characteristically having low resistance to extension and low rates of compression and relatively high resistance to high rates of compression and acting when extended to its maximum length as stop means limiting the extent of downward movement of said lift bar, and acting as safety means limiting the rate of upward movement of the lift bar in the event of the user slipping off.

* * * * *